United States Patent [19]

Hamada

[11] 4,438,194

[45] Mar. 20, 1984

[54] SILVER HALIDE COLOR PHOTOGRAPHIC PHOTOSENSITIVE MATERIAL

[75] Inventor: Fumio Hamada, Fussa, Japan

[73] Assignee: Konishiroku Photo Ind. Co., Ltd., Japan

[21] Appl. No.: 359,914

[22] Filed: Mar. 19, 1982

[30] Foreign Application Priority Data

Mar. 20, 1981 [JP] Japan ..... 56-42117

[51] Int. Cl.[3] ..... G03C 1/46

[52] U.S. Cl. ..... 430/505; 430/506; 430/509

[58] Field of Search ..... 430/503, 505, 506, 509

[56] References Cited

U.S. PATENT DOCUMENTS

| | | | |
|---|---|---|---|
| 2,350,380 | 6/1944 | White | 430/502 |
| 4,040,829 | 8/1977 | Ohmatsu et al. | 430/505 |
| 4,186,011 | 1/1980 | Lohmann et al. | 430/505 |

FOREIGN PATENT DOCUMENTS

| | | |
|---|---|---|
| 818233 | 8/1959 | United Kingdom . |
| 923045 | 4/1963 | United Kingdom . |

*Primary Examiner*—J. Travis Brown

*Attorney, Agent, or Firm*—Finnegan, Henderson, Farabow, Garrett & Dunner

[57] ABSTRACT

A silver halide color photographic photosensitive material comprising a base having thereon a non-photosensitive intermediate layer sandwiched between a high-sensitive silver halide emulsion layer and a low-sensitive silver halide emulsion layer both having a nondiffusion coupler that forms substantially the same color and having photosensitivity in substantially the same spectral region is disclosed. Said non-photosensitive intermediate layer has incorporated therein with a nondiffusion coupler that forms substantially the same color as that formed by the nondiffusion coupler contained in said high-sensitive emulsion layer and whose coupling speed is not greater than that of the nondiffusion coupler contained in said high-sensitive silver halide emulsion layer.

4 Claims, No Drawings

SILVER HALIDE COLOR PHOTOGRAPHIC PHOTOSENSITIVE MATERIAL

FIELD OF THE INVENTION

The present invention relates to a silver halide color photographic photosensitive material, and more particularly, to a taking silver halide color photographic photosensitive material having improved photographic characteristics such as high sensitivity, high graininess and good gradation.

BACKGROUND OF THE INVENTION

To meet the demand for the development of a color photographic photosensitive material having high sensitivity and using fine silver halide grains, many improved color photographic photosensitive materials have been proposed. One photosensitive material that complies with this demand is described in British Pat. No. 923,045. The material comprises a high-sensitive emulsion layer that contains a non-diffusion coupler and a discrete low-sensitive emulsion layer that contains another non-diffusion coupler which forms the same color. According to the British patent, by designing the high-sensitive emulsion layer to provide a lower maximum color density, increased sensitivity can be achieved without sacrificing the graininess.

But the ever increasing demand for providing the taking color photographic photosensitive material with even higher sensitivity has compelled using in emulsion layers coarse silver halide grains having low graininess and/or a coupler having great coupling speed. Under these circumstances, the method of Biritsh Pat. No. 923,045 is no longer satisfactory for achieving improved graininess, and so attempts have been made to provide further improved graininess. Japanese Patent Publication No. 15495/74 describes one such attempt. On page 4 of the published specification, this patent states that improved graininess can be provided by forming a gelatin layer between the high-sensitive and low-sensitive emulsion layers described in British Pat. No. 923,045. This method can improve the graininess of the low-density area, but it has significant adverse effect on the gradation. If the impaired degradation is remedied by a conventional technique, say, by increasing the size of the silver halide grains, the sensitivity of the low-sensitive emulsion layer is increased, but then the graininess of the medium-density area that is particularly important for practical purposes is decreased. Furthermore, the density of the color image formed by the multi-layer color photographic photosensitive material incorporating the proposal of Japanese Patent Publication No. 15495/74 is not stable against the variation in the developing conditions, such as pH, temperature and time.

Japanese Patent Publication No. 15495/74, as well as Japanese Patent Application (OPI) No. 7230/78 (the symbol OPI as used herein means an unexamined published Japanese patent application describe a process wherein the high-sensitive and low-sensitive emulsion layers of British Pat. No. 923,045 are interposed by a first medium-sensitive silver halide emulsion layer having lower color density and a second medium-sensitive silver halide emulsion layer also having lower color density but which contains a DIR compound. But this method is also not desired since the increased use of silver halide causes increased fog for one thing and results in increased consumption of precious silver resources for another.

SUMMARY OF THE INVENTION

Therefore, the primary object of the present invention is to provide a taking silver halide color photographic photosensitive material that has high sensitivity, good graininess and gradation and which exhibits high stability against color development and which uses a smaller amount of silver.

To achieve this object, the present inventors have made various studies with a silver halide color photographic photosensitive material comprising a base having thereon a nonphotosensitive intermediate layer sandwiched between a high-sensitive silver halide emulsion layer and a low-sensitive silver halide emulsion layer both having a nondiffusion coupler that forms substantially the same color and having photosensitivity in substantially the same spectral region. As a result, the present inventors have found that the stated object can be achieved by incorporating in said non-sensitive intermediate layer a nondiffusion coupler that forms substantially the same color as that formed by the nondiffusion coupler contained in said high-sensitive emulsion layer and whose coupling speed is not greater than that of the nondiffusion coupler contained in said high-sensitive silver halide emulsion layer.

Therefore, according to the present invention, a novel color photographic photosensitive material that accomplishes the stated object by the improved arrangement of photographic layers and by use of the improved coupler is offered.

DETAILED DESCRIPTION OF THE INVENTION

The color photographic photosensitive material of the present invention comprises a non-sensitive intermediate layer that is sandwiched between a high-sensitive emulsion layer and a low-sensitive emulsion layer. Each of the high-sensitive and low-sensitive emulsion layers may be made of a single layer, but each is preferably made of two or more layers since the advantages of the method of British Pat. No. 923,045 are added to those of the present invention. In the present invention, the high-sensitive emulsion layer is preferably disposed farther from the base than the low-sensitive emulsion layer. If each of the high-sensitive and low-sensitive emulsion layers is made of two or more layers, the layer closer to the base preferably has lower sensitivity than the adjacent outer layer.

Optimum difference in sensitivity between the high-sensitive and low-sensitive emulsion layers used in the present invention may be determined by a well known method in consideration of the gradation and graininess, and generally, the difference is in the range of from 0.1 to 1.0 log E (E: exposure).

According to the present invention, the non-sensitive intermediate layer that is sandwiched by the high-sensitive and low-sensitive silver halide emulsion layers that are sinsitive to substantially the same spectral region and which form substantially the same color can contain silver halide grains that have in the same spectral region a lower sensitivity than the silver halide grains contained in said low-sensitive silver halide emulsion layer. In addition to the coupler the intermediate layer can contain a hydroquinone derivative, so-called "weiss coupler" which forms in coupling reaction a colorless substance or fine silver halide grains for controlling the progress of development. The intermediate layer can also be made of two or more layers.

The coupler-containing color photographic photosensitive material generally consists of a red-sensitive silver halide emulsion layer containing a nondiffusion, cyan color forming coupler, a green-sensitive emulsion layer containing a nondiffusion magenta color forming coupler, and a blue-sensitive emulsion layer containing a nondiffusion, yellow color forming coupler. The expressions "having photosensitivity in substantially the same spectral region" and "forms substantially the same color" as used herein should be construed in their broad sense and they respectively mean that the couplers have red, green and blue spectra, as well as cyan, magenta and yellow colors. Therefore, a slight change in spectrum and color is included in the meaning of "substantially the same". The present invention exhibits significant advantages which regard to the cyan, magenta and yellow layers, and by applying the idea of the present invention to all layers, a final color image having good quality can be produced.

The preferred maximum color density of the high-sensitive emulsion layer and non-sensitive intermediate layer is from 2% to 70%, with respect to the maximum color density of the low-sensitive emulsion layer, and the particularly preferred value is from 5% to 60%. It is assumed here that the color formation by the coupler in the non-sensitive intermediate layer is due to its reaction with the oxidation product of the developing agent that is formed upon development of the high-sensitive and low-sensitive emulsion layers.

In the present invention, each of the high-sensitive emulsion layer and non-sensitive intermediate layer can contain two or more nondiffusion couplers. When two or more nondiffusion couplers are used, at least one of the couplers incorporated in the intermediate layer has a coupling speed equal to or smaller than the coupling speed of the nondiffusion coupler in the high-sensitive emulsion layer that has the greatest coupling speed. The nondiffusion coupler in the non-sensitive intermediate layer that has a coupling speed equal to or smaller than the coupling speed of the nondiffusion coupler in the high-sensitive emulsion layer that has the greatest coupling speed preferably accounts for at least 30%, more preferably at least 70%, of the nondiffusion couplers incorporated in the non-sensitive intermediate layer.

The coupling speed of any one of the couplers in the high-sensitive emulsion layer can be compared with that of any one of the couplers in the non-sensitive intermediate layer by the following method: a sample coupler is added to a silver halide emulsion prepared by a well known method, the amount of the coupler being 0.02 mols per mol of the silver halide; the mixture is subjected to sensitometry by a well known method, and the sensitivity at Fog density+0.1 is compared with the sensitivity of another sample that has been treated in the same manner. Before addition to the silver halide emulsion, each coupler is treated as follows: 2 mols of the coupler is dissolved under heating in a mixed solvent of 4 mols of tricresyl phosphate and 50 mols of ethyl acetate, and the solution is mixed with an aqueous gelatin solution containing sodium dodecylbenzenesulfonate, and the resulting mixture is emulsified by a high-speed mixer. If the coupler cannot be dissolved in the mixed solvent of tricresyl phosphate and ethyl acetate, it is first mixed with an equimolar amount of a high-boiling solvent, and the mixture is dissolved in a solvent that can dissolve the coupler.

Suitable nondiffusion couplers that are used in the high-sensitive emulsion layer and non-sensitive intermediate layer can be selected depending upon their coupling speed, and preferred examples are listed below.

Phenolic and naphtholic compounds are preferred as the nondiffusion cyan coupler used in the present invention, and a suitable cyan coupler can be selected from among those described in U.S. Pat. Nos. 2,369,929, 2,434,272, 2,474,293, 2,895,826, 3,253,924, 3,034,892, 3,311,476, 3,386,301, 3,419,390, 3,458,315, 3,476,563 and 3,591,383. The processes for producing these couplers are also disclosed in the references cited above.

Illustrative cyan couplers that are particularly useful in the present invention are listed below.

C-1: 1-Hydroxy-N-[δ-(2,4-di-t-amylphenoxy)butyl]-2-haphthamide

C-2: 1-Hydroxy-N-[γ-(2,4-di-t-amylphenoxy)propyl]-2-haphthamide

C-3: 2,4-Dichloro-3-methyl-6-(2,4-di-t-amylphenoxyacetamido)phenol

C-4: 2,4-Dichloro-3-methyl-6-[α-2,4-di-t-amylphenoxy)butylamido]-phenol

C-5: 2-Perfluorobutylamido-5-[α-(2,4-di-t-amylphenoxy)hexaneamido]-phenol

C-6: 1-Hydroxy-4-(octadecylsuccinimido)-N-ethyl-3',5'-dicarboxy-2-naphthamide

C-7: 1-Hydroxy-4-anilinocarbonyloxy-N-[δ-(2,4-di-tert-amylphenoxy)butyl]-2-naphthamide C-8: 1,2-Bis-[4-hydroxy-3-[N-[δ-(2,4-di-tert-amylphenoxy)butyl]-carbamoyl]-1-naphthyloxycarbamino]ethane C-9: 1-Hydroxy-4-(ethoxycarbonylmethoxy)-N-[δ-(2,4-di-tert-amyl)butyl]-2-naphthamide C-10: 1-Hydroxy-4-[β-methoxyethylaminocarbonylmethoxy]-N-[δ-(2,4-di-tert-amylphenoxy)butyl]-2-naphthamide C-11: 2-Chloro-3-methyl-4-carboxymethoxy-6-[β-(2,4-di-tert-amylphenoxy)butyloylamino]-phenol C-12: 1-Hydroxy-4-methoxycarbonyloxy-N-dodecyl-2-naphthamide C-13: 1-Hydroxy-4-(4-toluenesulfonamido)-N-[δ-(2,4-di-tert-amylphenoxy)butyl]-2-naphthamide C-14: 1-Hydroxy-4-(1-(naphthylaminocarbonyloxy)-N-[δ-(2,4-di-tert-amylphenxoy)butyl]-2-naphthamide C-15: 1-Hydroxy-4-[α-(β-methoxyethoxycarbonyl)ethoxy]-N-[δ-(2,4-di-tert-amylphenoxy)butyl]-2-naphthamide C-16: 1-Hydroxy-4-[4-(β-carboxypropaneamido)-phenoxy]-2-{N-[δ-(2,4-di-tert-amylphenoxy)-butylamino]}naphthoic acid amide C-17: 1-Hydroxy-4-(β-methylsulfonylmethoxy)-2-(N-hexadecyl)-naphthoic acid amide Phenolic or naphtholic derivatives are generally used as the nondiffusion colored cyan coupler in the present invention. Suitable phenolic or naphtholic cyan couplers are disclosed in, say, U.S. Pat. Nos. 2,521,908, 3,034,892, British Pat. No. 1,255,111, Japanese Patent Applications (OPI) Nos. 22028/73, 123341/75, 10135/75 and U.S. Pat. No. 3,476,563, together with the processes for producing the same.

Illustrative colored cyan couplers that can be used with advantage in the present invention are listed below.

CC-1: 1-Hydroxy-4-(2-acetylphenylazo)-N-[δ-(2,4-di-t-amylphenoxy)-butyl]-2-naphthamide CC-2: 1-Hydroxy-4-[2-(β-phenylpropionyl)phenylazo]-N-[β-(2,4-di-t-amylphenoxy)butyl]-2-naphthamide CC-3: 1-Hydroxy-4-phenylazo-4'-(4-t-butylphenoxy)-2-naphthanilide CC-4: 1-Hydroxy-4-[4-(1-hydroxy-8-acetamido-3,6-disulfo-2-naphthylazo)phenoxy]-N-[δ-(2,4-di-t-amylphenoxy)butyl]-2-naphthamide disodium salt CC-5: 1-Hydroxy-4-[4-(2-hydroxy-3,6-disulfo-1-naphthylazo)phenylcarbamoyloxy]-N-[δ-(2,4-di-t-amylphenoxy)butyl]-2-naphthamide disodium salt CC-6: 1-Hydroxy-4-(2-ethoxycarbonylphenylazo)-N-[δ-(2,4-di-t-amylphenoxy)butyl]-2-naphthamide Pyrazolone compounds, pyrazolotriazole compounds, pyrazolinobenzimidazole compounds and indazolone compounds can be used as the nondiffusion magenta coupler in the present invention. Pyrazolone magenta couplers are described in U.S. Pat. Nos. 2,600,788, 3,062,653, 3,127,269, 3,311,476, 3,419,391, 3,519,429, 3,558,318, 3,684,514, 3,888,680, Japanese Patent Application (OPI) Nos. 29639/74, 111631/74, 129538/74, 13041/75, Japanese Patent Application Nos. 24690/75, 134470/75, 156327/75 and 105820/76; pyrazolotriazole magenta couplers are described in U.S. Pat. No. 1,247,493 and Belgian Patent No. 792,525; pyrazolinobenzimidazole magenta couplers are described in U.S. Pat. No. 3,061,432, West German Patent No. 2,156,111 and Japanese Patent Publication No. 60479/71; indazolone magenta couplers are described in Belgian Patent No. 769,116. All of these magenta couplers can be used in the present invention with advantage.

Particularly useful magenta couplers are illustrated below.

M-1: 1-(2,4,6-Trichlorophenyl)-3-[3-(2,4-di-t-amylphenoxyacetamido)-benzamido]-5-pyrazolone M-2: 1-(2,4,6-Trichlorophenyl)-3-(3-dodecylsuccinimidobenzamido)-5-pyrazolone M-3: 4,4'-Methylenebis{1-(2,4,6-trichlorophenyl)-3-[3-(2,4,-di-t-amylphenoxyacetamido]benzamido}-5-pyrazolone M-4: 1-(2,4,6-Trichlorophenyl)-3-(2-chloro-5-octadecylsuccinimidoanilino)-5-pyrazolone M-5: 1-(2-Chloro-4,6-dimethylphenyl)-3-{3-[α-(3-pentadecylphenoxy)-butylamino]benzamido}-5-pyrazolone M-6: 1-(2,4,6-Trichlorophenyl)-3-(2-chloro-5-octadecylcarbamoyl-anilino)-5-pyrazolone M-7: 1-(2,4,6-Trichlorophenyl)-3-[3-(2,4-di-t-amylphenoxyhexylamido)benzamido]-5-pyrazolone M-8: 3-Ethoxy-1-{4-[α-(3-pentadecylphenoxy)-butylamino]phenyl}-5-pyrazolone M-9: 1-(2,4,6-Trichlorophenyl)-3-(2-chloro-5-tetradecaneamidoanilino)-5-pyrazolone M-10: 1-(2,4,6-Trichlorophenyl)-3-{2-chloro-5-[α-(3-t-butyl-4-hydroxy-phenoxy)tetradecaneamido]anilino}-5-pyrazolone M-11: 1-(2,4,6-Trichlorophenyl)-3-[3-(2,4-di-t-amylphenoxyacetamido)-benzamido]-4-acetoxy-5-pyrazolone M-12: 1-(2,4,6-Trichlorophenyl)-3-[3-(2,4-di-t-amylphenoxy-acetamido)-benzamido]-4-ethoxycarbonyloxy-5-pyrazolone M-13: 1-(2,4,6-Trichlorophenyl)-3-[3-(2,4-di-t-amylphenoxyacetamido)-benzamido]-4-(4-chlorocynnamoyloxy)-5-pyrazolone M-14: 1-(2,4,6-Trichlorophenyl-3-{3-(4-n-dodecylbenzenesulfonamido)-benzamido}-5-pyrazolone M-15: 4,4'-Benzylidenebis[1-(2,4,6-trichlorophenyl)-3-{2-chloro-5-[γ-(2,4-di-t-amylphenoxy)butylamido anilino}-5-pyrazolone]

M-16: 4,4'-Benzylidenebis[1-(2,3,4,5,6-pentachlorophenyl)-3-{2-chloro-5-[γ-(2,4-di-t-amylphenoxy)-butylamido]anilino}-5-pyrazolone]

M-17: 4,4'-(2-Chloro)benzylidenebis[1-(2,4,6-trichlorophenyl)-3-(2-chloro-5-dodecylsuccinimidoanilino)-5-pyrazolone]

M-18: 4,4'-Methylenebis[1-(2,4,6-trichlorophenyl)-3-{3-[α-(2,4-di-t-amylphenoxy)butylamido]benzamido}-5-pyrazolone A compound having an arylazo substituent on the coupling position of a colorless magenta coupler is generally used as the nondiffusion colored magenta coupler in the present invention. Suitable compounds are described in U.S. Pat. Nos. 2,801,171, 2,983,608, 3,005,712, 3,684,514, British Pat. No. 937,621, and Japanese Patent Application (OPI) Nos. 123625/74 and 31448/74. A colored magenta coupler of the type describe in U.S. Pat. No. 3,419,391 that releases the dye into the processing solution upon reaction with the oxidation product of the developing agent can also be used. Typical colored magenta couplers are named below.

CM-1: 1-(2,4,6-Trichlorophenyl)-4-(4-methoxyphenylazo-3-[3-(2,4-di-t-amylphenoxyacetamido)benzamido]-5-pyrazolone CM-2: 1-(2,4,6-Trichlorophenyl)-4-(1-naphthylazo)-3-(2-chloro-5-octadecenylsuccinimidoanilino)-5-pyrazolone CM-3: 1-(2,4,6-Trichlorophenyl)-4-(4-hydroxy-3-methylphenylazo)-3-(2-chloro-5-tetradecaneamidoanilino)-5-pyrazolone CM-4: 1-(2,4,6-Trichlorophenyl)-4-(4-hydroxy-3-methylphenylazo)-3-(2-chloro-5-octadecenylsuccinimidoanilino)-5-pyrazolone CM-5: 1-(2,4,6-Trichlorophenyl)-3-{2-chloro-5-[α-(4-hydroxy-3-t-butyl-phenoxy)tetradecaneamido]anilino}-4-(1-naphthylazo)-5-pyrazolone CM-6: 1-(2,4,6-Trichlorophenyl)-3-{2-chloro-5-[α-(2,4-di-t-amylphenoxy)butylamido anilino}-4-(4-methoxyphenylazo)-5-pyrazolone CM-7: 1-(2,4,6-Trichlorophenyl)-3-{2-chloro-5-[γ-2,4-di-t-amylphenoxy)butylamido]anilino}-4-(4-hydroxyphenylazo)-5-pyrazolone CM-8: 1-(2,3,4,5,6-Pentachlorophenyl)-3-{2-chloro-5-[γ-(2,4-di-t-amylphenoxy)butylamido]anilino}-4-(4-hydroxyphenylazo)-5-pyrazolone A conventional open-chain ketomethylene compound is used as the nondiffusion yellow coupler in the present invention, and commonly employed benzoyl acetanilide type yellow coupler or pivaloyl acetanilide type yellow coupler can be used. A two equivalent yellow coupler wherein the carbon atom on the coupling position is replaced by a substituent capable of elimination upon coupling reaction can be also be used with advantage. Suitable yellow couplers are described in U.S. Pat. Nos. 2,875,057, 3,265,506, 3,664,841, 3,408,194, 3,447,928, 3,277,155, 3,415,652, Japanese Patent Publication No. 13576/74, Japanese Patent Application (OPI) Nos. 29432/73, 66834/73, 10736/74, 122335/74, 28834/75 and 132926/75 together with the processes for producing the same.

Particularly advantageous yellow couplers are listed below.

Y-1: α-(4-Carboxyphenoxy)-α-pivalyl-2-chloro-5-[γ-(2,4-di-t-amylphenoxy)butylamido]acetanilide Y-2: α-Bivalyl-2-chloro-5-[γ-(2,4-di-t-amylphenoxy)-butylamido]acetanilide Y-3: α-Benzoyl-2-chloro-5-[α-(dedecyloxycarbonyl)ethoxycarbonyl]acetanilide Y-4: α-(4-Carboxyphenoxy)-α-pivalyl-2-chloro-5-[α-(3-pentadecylphenoxy)-butylamido]acetanilide Y-5: α-(1-Benzyl-2,4-dioxo-3-imidazolidinyl)-α-pivalyl-2-chloro-5-[γ-(2,4-di-t-amylphenoxy)-butylamido]acetanilide Y-6: α-[4-(1-Benzyl-2-phenyl-3,5-dioxo-1,2,4-triazolidinyl)]-α-pivalyl-2-chloro-5-[γ-(2,4-di-t-amylphenoxy)butylamido]acetanilide Y-7: α-Acetoxy-α-{3-[α-(2,4-di-t-amylphenoxy)-butylamido]benzoyl}-2-methoxyacetanilide Y-8: α-{3-[α-(2,4-di-t-amylphenoxy)butylamido]benzoyl}-2-methoxyacetanilide Y-9: α-[4-(4-Benzyloxyphenylsulfonyl)phenoxy]-α-pivalyl-2-chloro-5-[γ-(2,4-di-5-amylphenoxy)-butylamido]acetanilide Y-10: α-Pivalyl-α-(4,5-dichloro-3(2H)-pyridazo-2-yl)-2-chloro-5-[(hexadecyloxycarbonyl)methoxycarbonyl-]acetanilide Y-11: α-Pivalyl-α-[4-(p-chlorophenyl)-5-oxo-$\Delta^2$-tetrazoline-1-yl]-2-chloro-5-[α-(dodecyloxycarbonyl)ethoxycarbonyl acetanilide Y-12: α-(2,4-Dioxo-5,5-dimethyloxazolidine-3-yl)-α-pivalyl-2-chloro-5-[α-(2,4-di-t-amylphenoxy)-butylamido]acetanilide Y-13: α-Pivalyl-α-[4-(1-methyl-2-phenyl-3,5-dioxo-1,2,4-triazolidinyl)]-2-chloro-5-[γ-(2,4-di-t-amylphenoxy)butylamido]acetanilide Y-14: α-Pivalyl-α-[4-(p-ethylphenyl)-5-oxo-$\Delta^2$-tetrazoline-1-yl]-2-chloro-5-[γ-(2,4-di-t-amylphenoxy)-butylamido]acetanilide Y-15: α-(4'-Methoxybenzoyl)-α-pyrazolyl-2-chloro-5-dodecyloxycarbonylacetanilide The above listed nondiffusion couplers are used in the present invention in an amount of from $2\times10^{-3}$ to $5\times10^{-1}$ mols per mol of silver in the photosensitive silver halide emulsion layer. Preferably, the couplers are used in the high-sensitive emulsion layer in an amount of from $5\times10^{-3}$ to $5\times10^{-2}$ mols, and in the low-sensitive emulsion layer in an amount of from $2\times10^{-2}$ to $3\times10^{-1}$ mol. These couplers are used in the intermediate layer in an amount of from $1\times10^{-6}$ mol/dm$^2$ to $8\times10^{-5}$ mol/dm$^2$, preferably from $4\times10^{-6}$ mol/dm$^2$ to $3\times10^{-5}$ mol/dm$^2$.

Dispersions of the nondiffusion couplers can be prepared by various methods such as the aqueous alkali dispersion method, solid dispersion method, latex dispersion method, and the oil-in-water emulsion dispersion method, and a suitable method can be selected depending upon the chemical structure of the nondiffusion couplers.

For the purpose of the present invention, the latex dispersion method and oil-in-water emulsion dispersion method are particularly effective. These dispersion methods are well known, and the latex dispersion method and its advantages are described in Japanese Patent Application (OPI) Nos. 74538/74, 32552/79, and Research Disclosure, August 1976, No. 14850, pp. 77–79.

Suitable latices are homopolymers, copolymers and terpolymers of monomers such as styrene, ethyl acrylate, n-butyl acrylate, n-butylmethacrylate, 2-acetoacetoxyethyl methacrylate, sodium 2-(methacryloyloxy) ethyltrimethylammoniummetasulfate-3-(metacryloyloxy)propane-1-sulfonate, N-isopropylacrylamide, N-[2-(2-methyl-4-oxopentyl)]acrylamide, and 2-acrylamido-2-methylpropanesulfonic acid. As the oil-in-water emulsion dispersion method, a known technique can be used that produces a dispersion of a coupler or other hydrophobic additives. More specifically, the coupler is dissolved in a high-boiling organic solvent having a boiling point of 175° C. or more such as tricresyl phosphate or dibutyl phthalate and/or a low-boiling organic solvent such as ethyl acetate or butyl propionate, and the solution is mixed with an aqueous gelatin solution containing a surfactant, and then the mixture is emulsified by a high-speed mixer or colloid mill to prepare a coupler dispersion, which is added to the silver halide emulsion layer or intermediate layer either directly or after removing the low-boiling solvent by a known method.

A suitable colorless coupler that can be used with the couplers of the present invention can be selected from among those described in British Pat. Nos. 861,138, 914,145, 1,109,963, Japanese Patent Publication No. 14033/70, U.S. Pat. No. 3,580,722, and Mitteilungen Aus den Vorschning Laboratory in der AGFA Leverküsen, 4, 352,367 (1964).

For enhancing the advantages of the present invention, the high-sensitive emulsion, low-sensitive emulsion layer and/or the intermediate layer between these emulsion layers preferably contains a compound that releases a development inhibitor upon reaction with the oxidation product of the developing agent (such compound is hereunder referred to as a DIR compound). Details of the DIR compound are found in, say, U.S. Pat. No. 3,227,554 and Japanese Patent Application (OPI) No. 145135/79. The DIR compound is preferably used in an amount of up to 2 mg/dm$^2$, more preferably from 0.1 to 0.9 mg/dm$^2$, on the basis of the layer in which it is incorporated. For achieving better results, it is particularly preferred that the high-sensitive emulsion layer contain a DIR compound having greater reaction rate and that the low-sensitive emulsion layer contain one having a smaller reaction rate.

The silver halide emulsion layers of the color pyotographic photosensitive material according to the present invention contain a silver halide that is employed in the conventional silver halide photographic emulsion, such as silver chloride, silver bromide, silver iodide, silver chlorobromide, silver iodobromide or silver chloroiodobromide. The grains of these silver halides may be coarse or fine, and the grain size distribution maybe narrow or broad. Each of the silver halide grains may be a perfect crystal or twinned crystal, and the proportion of a (100) plane to a (111) plane may be of any value. These silver halide grains may have a uniform crystalline structure throughout, or they may have a lamellar structure wherein the surface has a different crystalline structure that the interior. These silver halide grains may be of the type that forms a latent image mainly on the surface, or may be of the type that forms a latent image mainly in the interior. These silver halide grains can be prepared by any of the known methods that are conventionally employed in the photographic industry.

The silver halide emulsions used in the present invention are preferably freed of soluble salts, but those emulsions containing soluble salts may also be used. Two or more separately prepared silver halide emulsions may be combined into one.

The silver halide emulsion layers of the color photographic photosensitive material of the present invention contain a known binder, such as a gelatin derivative, e.g. gelatin, phenylcarbamylated gelatin, acylated gelatin or phthalated gelatin. These binders may optionally be used as a mixture of two or more miscible components.

The silver halide photographic emulsion that has the above described silver halide grains dispersed in a liquid binder can ben sensitized with a chemical sensitizer. There are four types of chemical sensitizer that can be used in the present invention with advantage: a noble metal sensitizer, sulfur sensitizer, selenium sensitizer and a reduction sensitizer. Suitable noble metal sensitizers are a gold compound, ruthenium compound, rhodium compound, palladium compound, iridium compound, and a platinum compound. A gold compound can be used together with ammonium thiocyanate or sodium thiocyanate. Suitable sulfur sensitizers are activated gelatin and sulfur compounds. Suitable selenium sensitizers are activated or inert selenium compounds. Suitable reduction sensitizers are a stannous salt, polyamine, bisalkylaminosulfide, silane compound, iminoaminomethanesulfinic acid, hydrazinium salt and hydrazine derivative.

In addition to the additives mentioned above, the color photographic photosensitive material of the present invention may contain various additives useful for photographic photosensitive materials such as stabilizer, development accelerator, hardener, surfactant, antifouling agent, lubricant and UV absorber. In addition to the silver halide emulsions, the silver halide photographic photosensitive material of the present invention may optionally include an auxiliary layer such as a protective layer, intermediate layer, filter layer, antihalation layer or backing layer. The base on which these layers are formed may be made of a known material that is suitably selected from among a plastic film, plastic-laminated paper, baryta paper and synthetic paper depending upon the use and object of the photographic photosensitive material. The base is generally subbed to provide a strong bond to the photographic emulsion layers.

Preferred arrangements of layers in the color photographic photosensitive material are illustrated below. In each arrangement, the layer closer to the surface precedes the one closer to the base.

(Layer arrangement 1)

1. One or more blue-sensitive silver halide emulsion layers each containing a nondiffusion yellow coupler;
2. A yellow filter layer for absorbing blue light;
3. A high-sensitive green-sensitive silver halide emulsion layer containing a nondiffusion magenta coupler;
4. An intermediate layer containing a nondiffusion magenta coupler;
5. A low-sensitive green-sensitive silver halide emulsion layer containing a nondiffusion magenta compler;
6. One or more red-sensitive silver halide emulsion layers each containing a nondiffusion cyan coupler; and
7. A base (Layer arrangement 2)

1. One or more blue-sensitive silver halide emulsion layers each containing a nondiffusion yellow coupler;
2. A yellow filter layer for absorbing blue light;
3. A high-sensitive green-sensitive silver halide emulsion layer containing a nondiffusion magenta coupler;
4. An intermediate layer containing a nondiffusion magenta coupler;
5. A low-sensitive green-sensitive silver halide emulsion layer containing a nondiffusion magenta coupler in a lower density than in the layer 6;
6. A low-sensitive green-sensitive silver halide emulsion layer containing a nondiffusion magenta coupler in a higher density than in the layer 5;
7. One or more red-sensitive silver halide emulsion layers each containing a nondiffusion cyan coupler; and
8. A base (Layer arrangement 3)

1. One or more blue-sensitive silver halide emulsion layers each containing a nondiffusion yellow coupler;
2. A yellow filter for absorbing blue light;
3. One or more green-sensitive silver halide emulsion layers each containing nondiffusion magenta coupler;
4. A high-sensitive red-sensitive silver halide emulsion layer containing a nondiffusion cyan coupler;
5. An intermediate layer containing a nondiffusion cyan coupler;
6. A low-sensitive red-sensitive silver halide emulsion containing a nondiffusion cyan coupler; and
7. a base To form a color image on the silver halide color photographic photosensitive material according to the present invention, the material is first exposed to light and then processed by the conventional color development process. The basic process includes a color developing step, a bleaching step and a fixing step. These steps may be performed independently, and alternatively, two or more steps may be performed at a time using a processing solution capable of these steps. For example, color processing may be performed by a single bath containing a color developing agent, a ferric salt bleaching component and a thiosulfate fixing component, or both bleaching and fixing can be performed by a single bath containing an (ethylenediaminetetraacetato)iron (III) complex salt bleaching component and a thiosulfate fixing component.

The color photographic photosensitive material of the present invention can be processed by any known method without limitation. Typical methods are as follows: (1) a method wherein color development is followed by bleach-fixing, which is optionally followed by washing and stabilizing; (2) a method wherein color development is followed by separate bleaching and fixing steps, which are optionally followed by washing and stabilizing; (3) a method comprising, in sequence, prehardening, neutralization, color development, stop fixing, washing, bleaching, fixing, washing, after-hardening and washing; (4) a method which comprises, in sequence, color development, washing, amplified color development, stop, bleaching, fixing, washing and stabilizing; (5) a developing method wherein the developed silver produced by color development is halogenation-bleached, and the resulting silver halide is again subjected to color development to form more dye; and (6) a method wherein a photosensitive material with low silver content is processed with an amplifier such as peroxide or cobalt complex salt.

Typical color developing agents that can be used in the present invention are p-phenylenediamine compounds. The color developing agent can be incorporated in the color photographic photosensitive material. Suitable precursors for the color developing agent used in the present invention are those color developing agents of Schiff base type which are described in U.S. Pat. Nos. 2,507,114, 2,695,234, 3,342,599 and Research Disclosure, vol. 151, No. 15159, Nov. 1979, as well as those which are described in Research Disclosure, vol. 129, No. 12924, Oct. 1976, vol. 121, Nov. 12146, Jun. 1974, and vol. 139, No. 13924, Nov. 1975. The color developing solution may optionally contain various additives.

The present invention is now described in greater detail by reference to the following examples which are given here for illustrative purposes only and are by no means construed as limiting the scope of the invention.

EXAMPLE 1

Sample No. 1 was prepared by forming the following layers in sequence on a subbed cellulose triacetate film base (Layer-1 was the closest to the base).

Layer-1 . . . Low-sensitive red-sensitive silver halide emulsion layer

A silver iodobromide emulsion containing 4 mol% of silver iodide (av. grain size=0.7μ, containing 40 g of gelatin and 0.25 mol of silver halide per kg of the emulsion) was prepared by a conventional method. The emulsion (1 kg) was chemically sensitized with gold and sulfur sensitizers, and mixed with red-sensitive sensitizing dyes, i.e. anhydrous 9-ethyl-3,3'-di-(3-sulfopropyl)-4,5,4'5'-dibenzothiacarbocyaninehydroxide, anhydrous 5,5'-dichloro-9-ethyl-3,3'-di-(3-sulfopropyl)thiacarbocyaninehydroxide and anhydrous 5,5'-dichloro-3',9-diethyl-3-(4-sulfobutyl)-oxythiacarbocyaninehydroxide. To the mixture, 0.25 g of 4-hydroxy-6-methyl-1,3,3a,7-tetrazaindene, 20 mg of 1-phenyl-5-mercaptotetrazole and 0.2 g of polyvinyl pyrrolidone were added. To the resulting mixture, 500 ml of dispersion C-1 (to be described later) was added. The so prepared low-sensitive red-sensitive silver halide emulsion was applied to the base to give a dry thickness of 3.0μ.

Layer-2 . . . Intermediate layer

An aqueous gelatin solution was spread on Layer-1 to give a dry thickness of 1.0.

Layer-3 . . . High-sensitivity red-sensitive silver halide emulsion layer

A silver iodobromide emulsion containing 7 mol% of silver iodide (av. grain size=1.2μ, 0.25 mol of silver halide and 30 g of gelatin per kg of the emulsion) was prepared by a conventional method. The emulsion (1 kg) was chemically sensitized with gold and sulfur sensitizers, and mixed with red-sensitive sensitizing dyes, i.e. anhydrous 9-ethyl-3,3'-di-(3-sulfopropyl)-4,5,4',5'-dibenzothiacarbocyaninehydroxide, anhydrous 5,5'-dichloro-9-ethyl-3,3'-di-(3-sulfopropyl)thiacarbocyaninehydroxide, and anhydrous 5,5'-dichloro-3',9-diethyl-3-(4-sulfobutyl)oxathiacarbocyaninehydroxide. To the mixture, 0.25 g of 4-hydroxy-6-methyl-1,3,3a,7-tetrazaindene, 8 mg of 1-phenyl-5-mercaptotetrazole and 0.2 g of polyvinyl pyrrolidone were added. To the resulting mixture, 500 ml of dispersion C-2 (to be described later) was added. The so prepared high-sensitive red-sensitive silver halide emulsion was applied to Layer-2 to give a dry thickness of 2.0μ.

Dispersions C-1 and C-2 were prepared as follows.

Dispersion C-1

A mixture of 50 g of the cyan coupler C-1 of the present invention, 4 g of the colored cyan coupler CC-4 of the present invention and 0.5 g of the DIR compound D-1 (to be described later) was dissolved under heating in a mixture of 55 g of tricresyl phosphate (hereunder referred to as TCP) and 110 ml of ethyl acetate (hereunder referred to as EA). The solution was added to 400 ml of a 7.5% aqueous gelatin solution containing 4 g of sodium triisopropylnaphthalenesulfonate, and the mixture was emulsified by a colloid mill, and water was added to make 1000 ml.

Dispersion C-2

A mixture of the cyan coupler C-10 of the present invention and 0.1 g of the DIR compound D-2 (to be described later) was dissolved under heating in a mixture of 20 g of TCP and 50 ml of EA. The solution was added to 400 ml of a 7.5% aqueous gelatin solution containing 2 g of sodium triisopropylnaphthalenesulfonate, and the mixture was emulsified by a colloid mill, and water was added to made 1000 ml.

D-1: 2-(1-Phenyl-5-tetrazolylthio)-4-octadecylsuccinimido-1-indanone

D-2: 1-Hydroxy-N-(2-n-tetradecylocyphenyl)-4-1-phenyl-3-methyl-4-(1-phenyl-5-tetrazolylthio)methyl-5-pyrazolyloxy-2-naphthamide Samples Nos. 2 to 8 were prepared in the same manner except that Layer-2 and Layer-3 contained the cyan coupler dispersions indicated in Table 1 below. For gradation control, the low-sensitive emulsion layer of Sample No. 2 contained larger silver halide grains. The dispersions C-3 to C-6 used in Samples Nos. 3 to 8 were prepared as follows.

Dispersion C-3

This dispersion was prepared in the same manner as Dispersion C-2 except that the cyan coupler C-10 was replaced by C-16.

Dispersion C-4

This dispersion was prepared in the same manner as Dispersion C-2 except that the cyan coupler C-10 was replaced by a 1:1 mixture of C-1 and C-10.

Dispersion C-5

This dispersion was prepared in the same manner as Dispersion C-2 except that the cyan coupler C-10 was replaced by a mixture of C-1 and the DIR compound (D-2) was eliminated.

Dispersion C-6

This dispersion was the same as Dispersion C-2 except that the cyan coupler C-10 was replaced by C-2. The dispersions were used in Samples Nos. 3 to 8 in an amount of 11.3 ml/cm$^2$ to form a layer having a dry thickness of 1.0μ.

Each of Samples Nos. 1 to 8 was exposed to white light through an optical wedge, and subsequently processed according to the following scheme.

| Processing scheme (38° C.) | time |
|---|---|
| Color development | 2 min 10 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |

The following processing solutions were used in the respective steps.

| (Formation of the color developer) | |
|---|---|
| 4-Amino-3-methyl-N—ethyl-N—(β-hydroxyethyl)-aniline | 4.8 g |

-continued

| | |
|---|---|
| sulfate | |
| Anhydrous sodium sulfite | 0.14 g |
| Hydroxyamine.½sulfate | 1.98 g |
| Sulfuric acid | 0.74 g |

TABLE 1

| Sample No. | Dispersion in high-sensitive layer | Dispersion in intermediate layer | Difference in coupling speed Δlog E | Grain size of silver halide in low-sensitive layer (μ) | Properties of cyan color forming layer: Gamma | Granularity (RMS) | Stability to development (%) | Gradation |
|---|---|---|---|---|---|---|---|---|
| 1 (outside the present invention) | C-2 | None | | 0.7 | 0.55 | 45 (Good) | 75 (Poor) | Poor |
| 2 (outside the present invention) | C-2 | None | | 0.9 | 0.58 | 70 (Poor) | 73 (Poor) | Good |
| 3 (outside the present invention) | C-2 | C-3 | (C-10) − (C-16) = 0.15 | 0.7 | 0.57 | 60 (Poor) | 86 (Good) | Good |
| 4 (of the present invention) | C-2 | C-2 | (C-10) − (C-10) = 0.0 | 0.7 | 0.57 | 50 (Good) | 88 (Good) | Good |
| 5 (of the present invention) | C-2 | C-4 | (C-10) − (C-10) = 0.0<br>(C-10) − (C-1) = 0.15 | 0.7 | 0.57 | 40 (Good) | 86 (Good) | Good |
| 6 (of the present invention) | C-2 | C-5 | (C-10) − (C-1) = 0.15 | 0.7 | 0.56 | 40 (Good) | 87 (Good) | Good |
| 7 (of the present invention) | C-2 | C-6 | (C-10) − (C-2) = 0.15 | 0.7 | 0.57 | 40 (Good) | 87 (Good) | Good |
| 8 (of the present invention) | C-3 | C-2 | (C-16) − (C-10) = 0.15 | 0.7 | 0.58 | 40 (Good) | 88 (Good) | Good |

| | |
|---|---|
| Anhydrous potassium carbonate | 28.85 g |
| Anhydrous potassium hydrogencarbonate | 3.46 g |
| Anhydrous potassium sulfite | 5.10 g |
| Pottassium bromide | 1.16 g |
| Sodium chloride | 1.14 g |
| Nitrilotriacetic acid trisodium salt monohydrate | 1.20 g |
| Pottassium hydroxide | 1.48 g |
| Water to make one liter | |
| (Formulation of the bleaching solution) | |
| Ethylenediaminetetraacetic acid ion ammonium salt | 100.0 g |
| Ethylenediaminetetraacetic acid diammonium salt | 10.0 g |
| Ammonium bromide | 150.0 g |
| Glacial acetic acid | 10.0 ml |
| Water to make one liter, and ammonia water to adjust the pH to 6.0 | |
| (Formulation of the fixer) | |
| Ammonium thiosulfate | 175.0 g |
| Anhydrous sodium sulfite | 8.6 g |
| Sodium metasulfite | 2.3 g |
| Water to make one liter, and acetic acid to adjust the pH to 6.0 | |
| (Formulation of the stabilizing solution) | |
| Formalin (as 37% aqueous solution) | 1.5 ml |
| Konidaks (product of Konishiroku Photo Industry Co., Ltd.) | 7.5 ml |
| Water to make one liter | |

The color images formed on the respective samples were checked for their sensitivity, gamma, granularity and stability to development. The results are shown in Table 1. The figures in the columns of "gamma" and "granularity" of the color image forming unit layer are the values after exposure to white light. The figures in the column of "granularity (RMS)" are 1000 times the standard deviation of the variation in the density as scanned by a microdensitometer having a circular scanning bore of 2.5μ. The figures in the column of "stability to development" are indicated by $\gamma s/\gamma o \times 100$ (%), wherein $\gamma o$ represents the gamma value obtained under the development conditions indicated above and $\gamma s$ represents the gamma value obtained by a shorter development time (1 min 55 sec). The closer to 100% the ratio is, the higher the stability to development. The gradation is evaluated by the linearity of the H & D curve in the medium-density area. The higher the linearity, the better the gradation.

As is clear from Table 1, Samples Nos. 4 to 8 of the novel color photographic photosensitive material according to the present invention had better granularity, greater stability to development and better gradation than Samples Nos. 1 to 3 which were outside the scope of the present invention. These advantages of the present invention were by no means obvious from the prior art techniques.

EXAMPLE 2

Sample No. 9 which was outside the scope of the present invention was prepared by forming the following layers in sequence on a subbed cellulose triacetate film base (Layer-1 was the closest to the base).

Layer-1 . . . Low-sensitive green-sensitive silver halide emulsion layer (1)

A silver iodobromide emulsion containing 6 mol% of silver iodide (av. grain size=0.3μ, containing 0.25 mol of the silver halide and 40 g of gelatin per kg of the emulsion) was prepared by a conventional method. The emulsion (1 kg) was chemically sensitized with gold and sulfur sensitizers, and mixed with green-sensitive sensitizing dyes, i.e. anhydrous 5,5'-dichloro-9-ethyl-3,3'-di-(3-sulfopropyl)oxacarbocyaninehydroxide, anhydrous 5,5'-diphenyl-9-ethyl-3,3'-di-(3-sulfopropyl)oxacarbocyanine and anhydrous 9-ethyl-3,3'-di-(3-sulfopropyl)-5,6,5',6'-dibenzoxacarbocyaninehydroxide. To the mixture, 0.25 g of 4-hydroxy-6-methyl-1,3,3a,7-tetrazaindene, 20 mg of 1-phenyl-5-mercaptotetrazole and 0.2 g of polyvinyl pyrrolidone were added. The so sensitized emulsion was identified as Emulsion A. Separately from Emulsion A, a silver iodobromide emulsion containing 6 mol% of silver iodide (av. grain size=0.7μ, containing 0.25 mol of silver halide and 40 g of gelatin per kg of the emulsion) was prepared by a conventional method, and then sensitized by the same method as used to prepare Emulsion A but by reducing the amount of the sensitizers and stabilizers by half. The so sensitized emulsion was identified as Emulsion B. Two emulsions were mixed in equal amounts. To the mixed emulsion (1 kg), 500 ml of Dispersion M-1 (to be identified later) was added, and the resulting low-sensitive green-sensitive silver halide emulsion (1) was spread on the base to give a dry thickness of 3.0μ.

Layer 2 . . . Low-sensitive green-sensitive silver halide emulsion layer (2)

A 1:1 mixture of Emulsion A and Emulsion B (1 kg) the same as used in Layer-1 was blended with 200 ml of Dispersion M-2 (to be identified below), and the resulting low-sensitive green-sensitive silver halide emulsion (2) was spread on Layer-2 to give a dry thickness of 1.5μ.

Layer-3 . . . Intermediate layer

An aqueous gelatin solution was applied onto Layer-2 to give a dry thickness of 1.0μ.

Layer 4 . . . High sensitive green-sensitive silver halide emulsion layer

A silver iodobromide emulsion (av. grain size=1.2μ, containing 0.25 mol of silver halide and 30 g of gelatin per kg of the emulsion) was prepared by a conventional method. The emulsion (1 kg) was chamically sensitized with gold and sulfur sensitizers, and mixed with green-sensitive sensitizing dyes, i.e. anhydrous 5,5'-dichloro-9-ethyl-3,3-di-(3-sulfopropyl)-oxacarbocyaninehydroxide, anhydrous 5,5'-di-phenyl-9-ethyl-3,3'-di-(3-sulfopropyl)oxacarbocyanine and anhydrous 9-ethyl-3,3'-di-(3-sulfopropyl)-5,6,5'6'-dibenzoxacarbocyaninehydroxide. To the mixture, 0.25 g of 4-hydroxy-6-methyl-1,3,3a,7-tetrazaindene, 5 mg of 1-phenyl-5-mercaptotetrazole and 0.2 g of polyvinylpyrrolidone were added. To the resulting mixture, 200 ml of Dispersion M-3 (to be identified below) was added. The so prepared high-sensitive green-sensitive silver halide emulsion was spread on Layer-3 to give a dry thickness of 2.0μ.

Dispersions M-1, M-2 and M-3 were prepared as follows.

Dispersion M-1

A mixture of 54 g of the magenta coupler M-1, 14 g of the colored magenta coupler CM-2, 0.5 g of the DIR compound D-3 (to be identified below) and 0.5 g of the DIR compound D-1 identified in Example 1 was dissolved in a mixture of 68 g of TCP and 280 ml of EA. The solution was added to 500 ml of 7.5% aqueous gelatin containing 8 g of sodium tri-isopropylnaphthalenesulfonate, and the mixture was emulsified by a colloid mill and water was added to make 1000 ml.

Dispersion M-2

The magenta coupler M-7 (60 g) was dissolved in a mixture of 60 g of TCP and 180 ml of EA, and the solution was added to 500 ml of 7.5% aqueous gelatin containing 8 g of sodium triisopropylnaphthalenesulfonate, and the mixture was emulsified by a colloid mill and water was added to make 1000 ml.

Dispersion M-3

A mixture of 30 g of the magenta coupler M-1, 30 g of M-3, 12 g of the colored magenta coupler CM-2 and the DIR compound D-2 identified in Example 1 was dissolved in a mixture of 70 g of TCP and 280 ml of EA. The solution was added to 500 ml of 7.5% aqueous gelatin containing 8 g of sodium triisopropylnaphthalenesulfonate. The resulting mixture was emulsified by a colloid mill and water was added to make 1000 ml.

D-3: 2-(2-Amino-1,3,4-thiadiazolyl-5-thio)-4-octadecylsuccinimido-1-indanone

Sample No. 10 that was included within the scope of the present invention was prepared in the same manner except that Layer-3 contained Dispersion M-4 (to be identified below). The dispersion M-4 was incorporated in an amount of 11.3 ml/cm$^2$.

The difference in coupling speed (Δ log E) of the magenta couplers M-1, M-3 and CM-2 contained in the high-sensitive emulsion layers, as well as the magenta coupler M-1 contained in the intermediate layer of Sample No. 10 was measured. The respective values were +0.15 for M-3 and +0.05 for CM-2 as compared with 0 for M-1. The coupling speed of M-1 was the smallest.

Dispersion M-4

This dispersion was the same as Dispersion M-2 except that the magenta coupler M-7 was replaced by M-1.

Samples Nos. 9 and 10 were checked for their gamma, gradation, granularity and stability to development by the same methods of evaluation as described in Example 1. With respect to the gamma and granularity, Sample No. 10 of the present invention was almost equal to Sample No. 9 which was outside the scope of the present invention but Sample No. 10 was superior to Sample No. 9 with respect to the gradation and stability to development.

What is claimed is:

1. A silver halide color photographic photosensitive material comprising a base having thereon a non-photosensitive intermediate layer sandwiched between a high-sensitive silver halide emulsion layer and a low-sensitive silver halide emulsion layer both having a nondiffusion coupler that forms substantially the same color and having photosensitivity in substantially the same spectral region, said non-photosensitive intermediate layer having been incorporated therein with a nondiffusion coupler that forms substantially the same color as that formed by the nondiffusion coupler contained in said high-sensitive emulsion layer and whose coupling speed is not greater than that of the nondiffusion coupler contained in said high-sensitive silver halide emulsion layer.

2. A silver halide color photographic photosensitive material according to claim 1, wherein said high and low-sensitive silver halide emulsion layers being red-sensitive or green-sensitive and said nondiffusion coupler being incorporated in the non-photosensitive intermediate layer and being a cyan coupler or a magenta coupler respectively.

3. A silver halide color photographic photosensitive material according to claim 1 or 2, wherein the amount of nondiffusion coupler having been incorporated in the high-sensitive emulsion layer and the non-photosensitive intermediate layer being such that the maximum color density thereof becomes 2% to 60% with respect to the maximum density of the low sensitive emulsion layer.

4. A silver halide color photographic photosensitive material according to claim 1, wherein the nonphotosensitive intermediate layer contains silver halide grains having a lower sensitivity in the same spectral region than the silver halide grains in the low sensitive silver halide emulsion layer.

* * * * *